US005496033A

United States Patent [19]

Thompson

[11] Patent Number: 5,496,033

[45] Date of Patent: Mar. 5, 1996

[54] INDOOR GOLF FACILITY

[76] Inventor: Michael A. Thompson, 8255 Smiley Ave., Utica, Mich. 48087

[21] Appl. No.: 908,850

[22] Filed: Jul. 1, 1992

Related U.S. Application Data

[63] Continuation of Ser. No. 624,574, Dec. 10, 1990, abandoned.

[51] Int. Cl.[6] ..... A63J 3/00; E04B 1/343

[52] U.S. Cl. ..... 273/176 R; 273/35 R; 273/411; 472/92; 52/211; 47/17

[58] Field of Search ..... 273/176 R, 176 AA, 273/176 AB, 176 B, 176 D, 176 E, 176 F, 35 B, 411; 272/3; D25/3, 12, 13, 15, 21, 103; 52/80, 2 R, 2 D, 2 N, 169.1, 169.2, 169.3, 169.4, 169.11; 405/130, 131; 47/17, 19; 472/92

[56] References Cited

U.S. PATENT DOCUMENTS

| | | | |
|---|---|---|---|
| 1,247,166 | 11/1917 | Steelquist | 405/131 |
| 1,904,001 | 4/1933 | Kimmel | 405/131 |
| 1,967,803 | 7/1934 | Boland | 405/131 |
| 2,894,749 | 7/1959 | Rook | 272/3 |
| 3,695,619 | 10/1972 | Brobston | 273/176 A |
| 3,744,191 | 7/1973 | Bird | 52/2 R |
| 4,167,266 | 9/1979 | Tabicman | 273/35 B |
| 4,550,533 | 11/1985 | Fraioli | 52/2 R |
| 5,026,060 | 6/1991 | Beeber | 273/176 F |

FOREIGN PATENT DOCUMENTS

| | | | |
|---|---|---|---|
| 2618343 | 1/1989 | France | 273/176 R |

*Primary Examiner*—William M. Pierce
*Attorney, Agent, or Firm*—Lyman R. Lyon

[57] ABSTRACT

An indoor golf facility comprises an air supported ultraviolet light translucent canopy overlying an undulating natural grass playing surface. A plurality of curtains are suspended from the canopy and are arranged in an array defining a plurality of fairways, each of which is divergent from a tee portion to a green portion.

1 Claim, 3 Drawing Sheets

INDOOR GOLF FACILITY

This is a continuation of application Ser. No. 07/624,574 filed on Dec. 10, 1990, now abandoned.

BACKGROUND OF THE INVENTION

Historically, natural grass has not been used in the environment of a domed or closed stadium. However, the capability to grow grass indoors through the winter season is in great demand due to the popularity of covered driving ranges. Such golf facilities answer the need for winter golf practice and play for golfers trapped in northern climates. The present invention is directed to a totally integrated indoor golf facility that utilizes natural grass and provides for the proper maintenance thereof.

SUMMARY OF THE INVENTION

A constructed embodiment comprises an air-supported structure which allows golfers to play a pitch-and-putt, nine-hole, par-three game on natural turf thereby to fill the competitive needs of the golfer. The air supported structure covers approximately 40,000 square feet. Direct soil heating is installed under each green and fairway, giving an ambient soil temperature of 55° to 60° F. 2.75 million BTU's of heat is supplied to the structure which is maintained at an average inside air temperature of about 60° in most northern states. The fabric used in the air structure is available from the Dupont Chemical Corporation, and allows at least 40% of the natural ultraviolet light to pass. To compensate in part for loss of natural light, carbon dioxide is added to the atmosphere and 24,000 watts of metal halide lighting is employed to encourage turf growth during the hours that the course is closed to the public. Access walkways insure minumum wear on the fairway grass areas. A sprinkler system insures correct water regulation and a humidity module controls ventilation. Accessibility for grass cutting and feeding is designed into the structure.

A novel curtain system divides the air supported structure into individual divergent fairways having tees and greens yet allows free access to four emergency exits thereby meeting the most stringent safety regulations.

| Hole | Length | Green Area |
|---|---|---|
| 1 | 22 yds. | 1,536 sq. ft. |
| 2 | 41 yds. | 2,400 sq. ft. |
| 3 | 34 yds. | 2,112 sq. ft. |
| 4 | 40 yds. | 2,200 sq. ft. |
| 5 | 25 yds. | 1,600 sq. ft. |
| 6 | 30 yds. | 1,840 sq. ft. |
| 7 | 24 yds. | 2,300 sq. ft. |
| 8 | 20 yds. | 1,600 sq. ft. |
| 9 | 45 yds. | 1,920 sq. ft. |
| Totals: | 281 yds. | 17,508 sq. ft. |

BRIEF DESCRIPTION OF THE DRAWINGS

FIG. 3 is an enlarged fragmentary view, similar to FIG. 2, of the underground soil heating system.

DETAILED DESCRIPTION OF THE PREFERRED EMBODIMENT OF THE INVENTION

Figure 1:
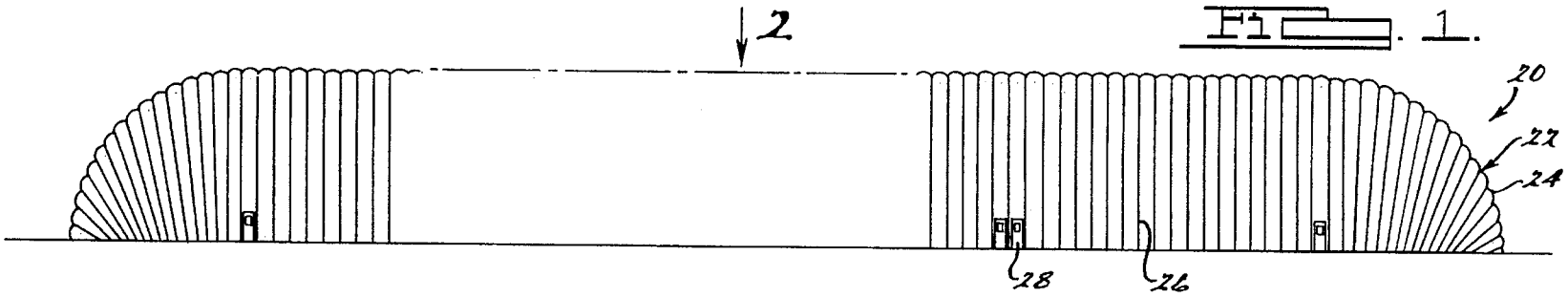
FIG. 1 is a side elevational view of an indoor golf facility in accordance with a constructed embodiment of the instant invention.

As seen in FIG. 1 of the drawing, an indoor golf facility 20 comprises an air supported plasticized fabric enclosure 22. The enclosure 22 is translucent so as to be capable of transmitting light in the ultraviolet spectrum which is required for the photosynthesis process necessary to the growing of grass. The fabric enclosure 22 is retained in position by a plurality of spaced cables 26 which are anchored in the conventional manner. Suitable entry and emergency exit doors 28 are provided to insure adequate egress from the facility 20 in the event of failure of the air support system.

Figure 2:
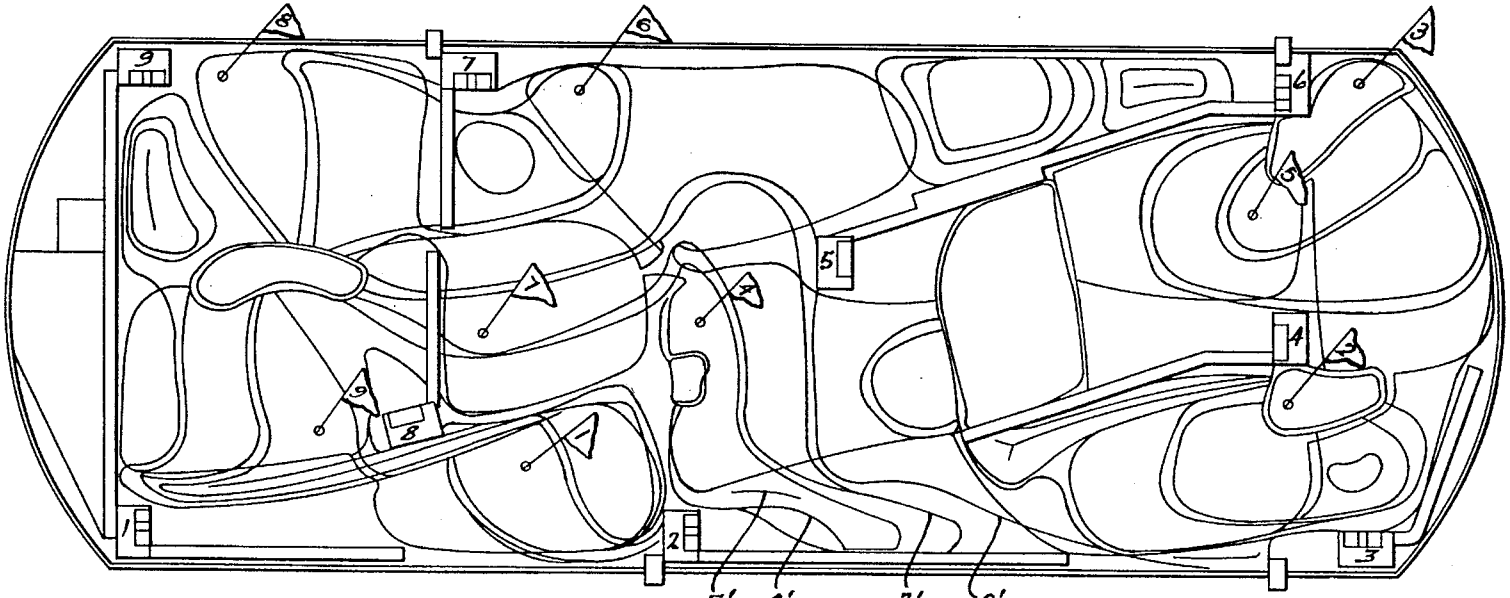
FIG. 2 is a top view of the interior of the facility taken in the direction of the arrow 2 of FIG. 1.
Figure 2:
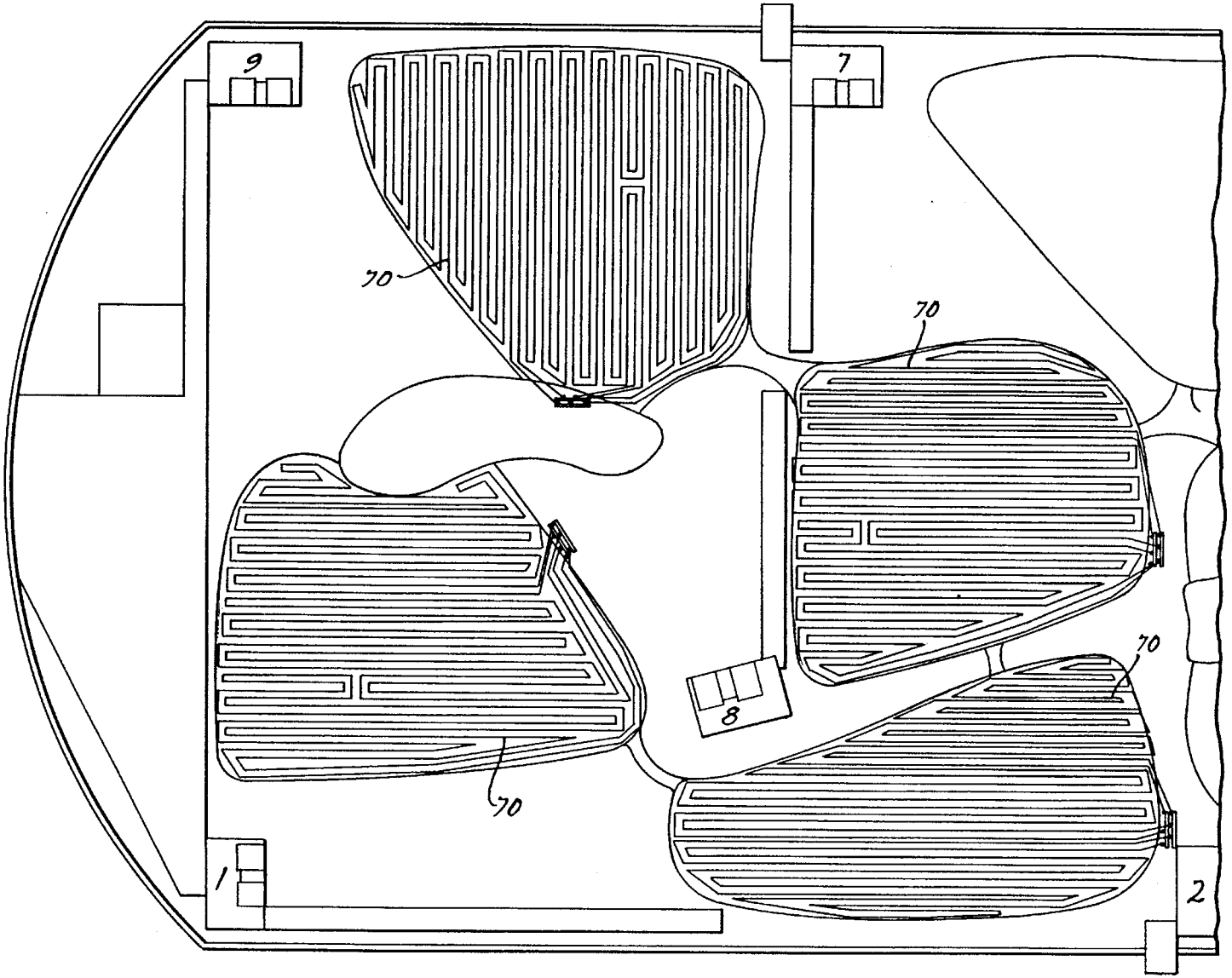
Figure 4:
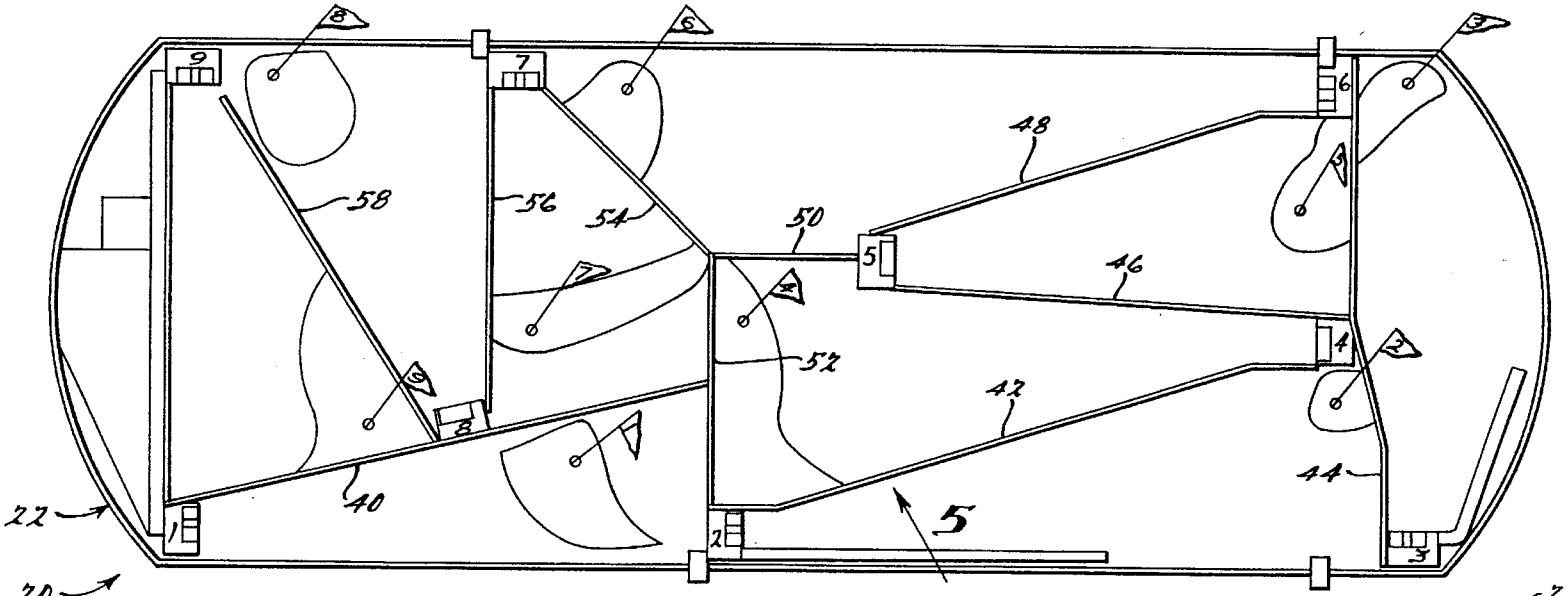
FIG. 4 is a top plan view similar to FIG. 2 showing the curtain orientation.
Figure 5:
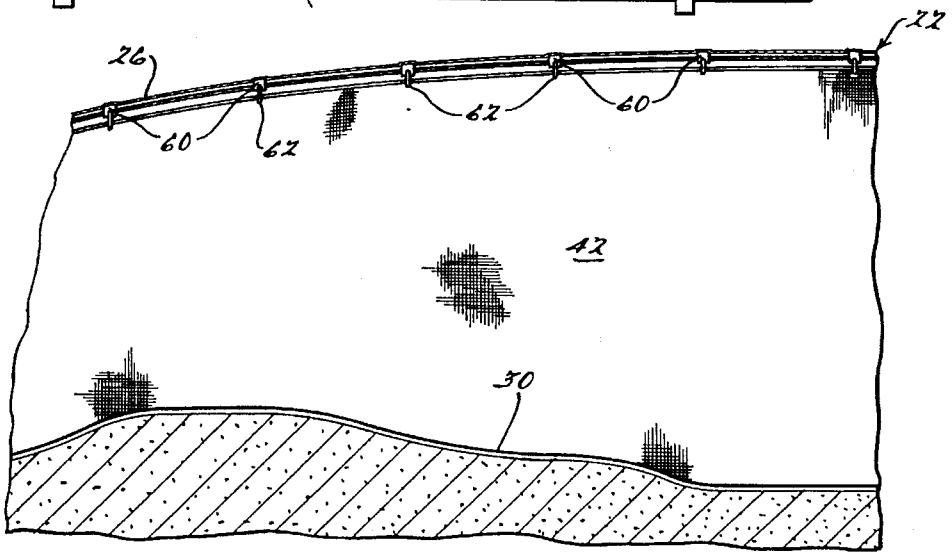
FIG. 5 is a view taken in the direction of the arrow 5 of FIG. 4.

As best seen in FIG. 2 of the drawing, the facility 20 has a foot-print of approximately 40,000 sq. ft. which is divided into a nine hole pitch-and-putt course. Nine holes are laid out in a manner that makes the course interesting to play and ascetically pleasing. One of the features of the instant invention is that the natural grass surface is grown on an undulating surface 30 which varies, as shown by the topographical lines on FIG. 2 of the drawing, from 0 to 5 ft. in height.

In accordance with one feature of the instant invention, the fairways are protected by a plurality of curtains 40–58 laid out in an array that defines the tee, fairway, and green area of each hole. The curtains 40–58 are suspended from the restraint cables 26. Fabric hangers 60 extend downwardly from the cables 26 to support the curtains 40–58 which are attached thereto by hooks 62. Lower edge contours of the curtains 40–58 are contoured so as to be complementary to the undulating surface of the fairways and greens of each hole. It is to be noted that the curtains 40–58 are disposed in a generally outwardly fanning or divergent configuration from each tee so as to be consistent with the impact area normally found on a golf course.

In accordance with yet another feature of the invention, and as best seen in FIG. 3 of the drawing, the fairways and greens of the golf facility 20 are provided with underground heaters in the form of hot water pipes 70. Each zone is divided into, for example, three separate piping segments which are fed from common manifolds. Control of temperature of the soil is automatic and is metered by conventional probes (not shown) in the soil. Thus, the ambient temperature of the soil can be maintained at an optimum temperature that promotes photosynthesis and therefore the growth process of the grass.

The control temperature in combination with interior lighting and proper application of fertilizer renders the maintenance of natural grass within the facility 20 both reasonable and practical.

In a practical application of the aforesaid structure, interactions between wear on turf, fertilization rates, and mowing practices were studied. Turf color and quality ratings were monitored. Recordings of light penetration percentages and carbon dioxide levels were taken inside the structure, which was maintained at a temperature of 68° F. Clippings were weighed after each mowing.

Four different fertilizer treatment programs were tested, namely, Nitrogen, high rate—¾# per 1000 sq. ft. and low rate—⅜# per 1000 sq. ft. along with Potassium at high rate—¾# per 1000 sq. ft. and low rate—⅜# per 1000 sq. ft. The grass was mowed at ⅜" height and at 3/16" height cut. Foot-traffic of all plots was controlled. The low level of traffic consisted of 50 trips per week and the high rate was 100 trips per week. The rates were increased to 100/week and 200/week to increase the visual wear symptoms.

Visual ratings for color and quality indicates that the highest quality turf results from a ⅜" mowing height under low traffic regimes and with low (⅜#) nitrogen rates and either low or high rates of potassium.

Light measurements indicate that the turf was subjected to a shade stress internally of the structure. Recordings were taken at intervals inside the structure along a wall, in the center, and outside the structure in open daylight. Light measured along an inside wall peaks at around 1:30 p.m. at about 52% of the saturation point for photosynthesis. Averages recorded at the center of the structure peak at about 46% of the saturation point for photosynthesis. Outside light peaked slightly later, around 2:00 p.m., at roughly 118% of the saturation point. Light intensity outside the structure increased at a higher rate proportionally than light penetration as measured inside the structure.

Carbon dioxide levels were also recorded inside the structure at ground level and at a height of seven feet, while outside measurements were recorded at a height of seven feet. A level of 300 ppm would be normal under ordinary conditions. Measurements recorded inside the structure averaged 385 ppm at ground level and 378 seven feet above the ground. Outside measurements averaged 366 ppm. This indicates that carbon dioxide is neither a limiting factor or a factor that contributes to the photosynthetic process.

Clipping weight data indicates that plots mowed at ⅜' height produce less clippings than the plots mowed at a 3/16" height.

Experience also indicates that low nitrogen levels along with moderate levels of potassium help the grass recover quickly under stress conditions.

While the preferred embodiment of the invention has been disclosed, it should be appreciated that the invention is susceptible of modification without departing from the scope of the following claims.

I claim:

1. An indoor golf facility comprising an undulating natural grass playing surface, an air pressure differential supported enclosure of ultraviolet light translucent material enclosing said playing surface, the light translucent material of said enclosure extending over all portions of said playing surface and downwardly to close proximate relation to said playing surface along the periphery thereof, and a plurality of curtains suspended from said enclosure and arranged in an array that demarks a plurality of conventional golf playing areas comprising tees, fairways and greens, respectively; each of said golf playing areas being of generally triangular configuration with the tee thereof at an apex and the green at an opposite side of each triangular playing area whereby each fairway is divergent from the tee to the green of each playing area, said curtains extending downwardly from close proximity to said enclosure and having undulating bottom edges, respectively, complementary to the undulations of said playing surface and in close proximate relation thereto so as to preclude passage of a golf ball from one playing area to an adjacent playing area.

* * * * *